United States Patent [19]

Hampton

[11] 4,328,984

[45] May 11, 1982

[54] WORK AND METHOD FOR INCLUSION OF THREE OR MORE CORDS OF DIFFERENT COLORS INTO A CAVENDOLI TYPE MACRAME PATTERN

[76] Inventor: Juandine B. Hampton, 1294 Fuller Ave., Simi Valley, Calif. 93065

[21] Appl. No.: 146,069

[22] Filed: May 2, 1980

[51] Int. Cl.[3] ..... D04C 5/00

[52] U.S. Cl. ..... 289/1.2; 289/1.5; 289/16.5

[58] Field of Search ..... 289/1.2, 1.5, 16.5

[56] References Cited

U.S. PATENT DOCUMENTS 4,142,745 3/1979 Offik ..... 289/1.5

OTHER PUBLICATIONS

Macrame, by the Editors of Sunset Books; Lane Publishing Co., Menlo Park, Ca., copyright 1971; pp. 26–27.

*Primary Examiner*—Louis Rimrodt

*Attorney, Agent, or Firm*—Roger A. Marrs

[57] ABSTRACT

A method and a workpiece is disclosed herein for adding three or more different bobbin cords into a desired pattern. The disclosure employs a background of a plurality of working cords arranged in spaced apart rows through which a main knot holding cord is threaded and tied in a multiplicity of double half hitches. A first bobbin cord of a different color than the other cords is introduced into the workpiece adjacent a pair of double half hitches on the next working cord and the bobbin cord passes through each half hitch of the double half hitch. The free length of the bobbin cord may be hidden behind subsequent work in the pattern for re-use by additional double half hitches. Additional bobbin cords of various colors may be introduced on other working cords by tying double half hitches thereon while permitting the main knot holding cord and the bobbin cord of different color to pass through each half hitch. All knots are drawn tight about their respective working cords so that the desired pattern of selected colors is sharply defined and displayed.

7 Claims, 20 Drawing Figures

PRIOR ART
FIG. 1A
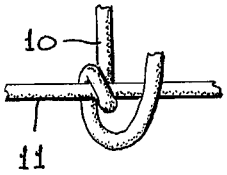
FIG. 1B
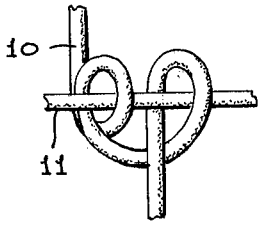
FIG. 1C
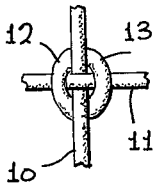
FIG. 1D
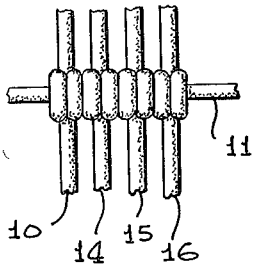
FIG. 2
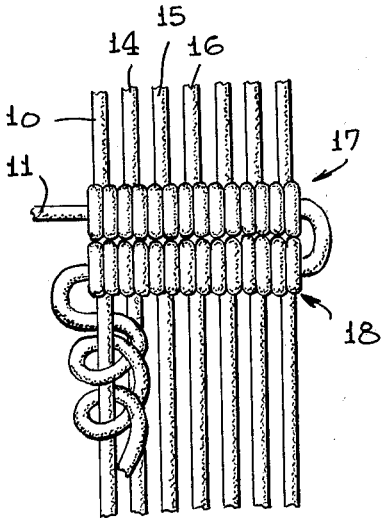
FIG. 3
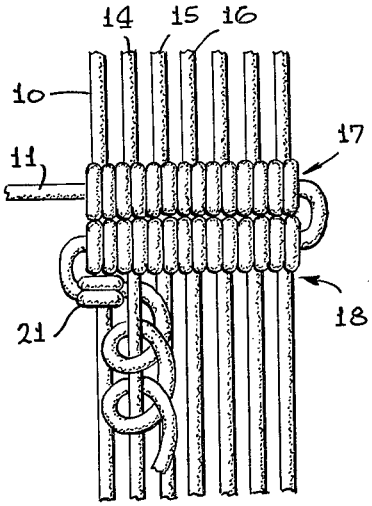
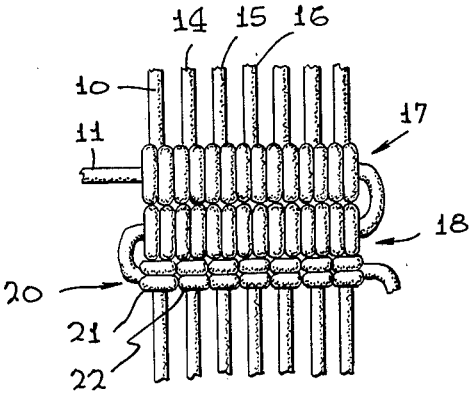
FIG. 4
FIG. 5
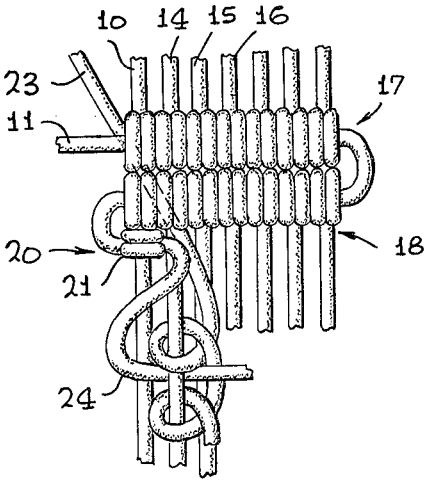

FIG. 6
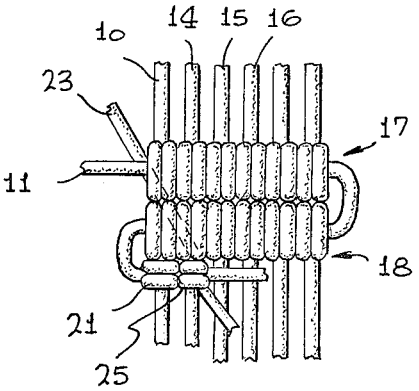
FIG. 7
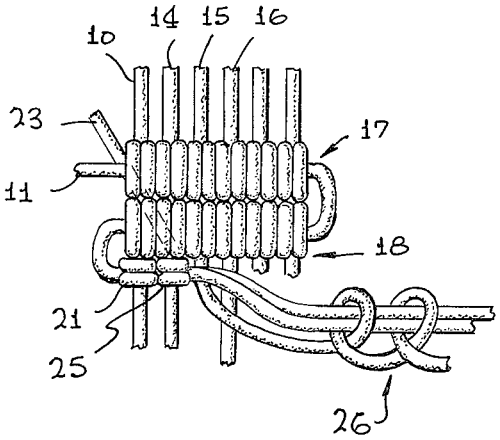
FIG. 8
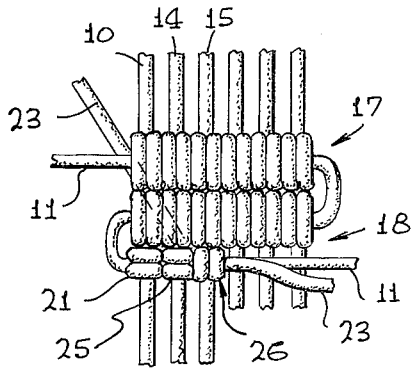
FIG. 9
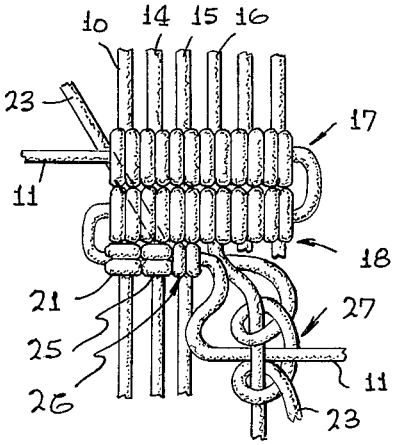
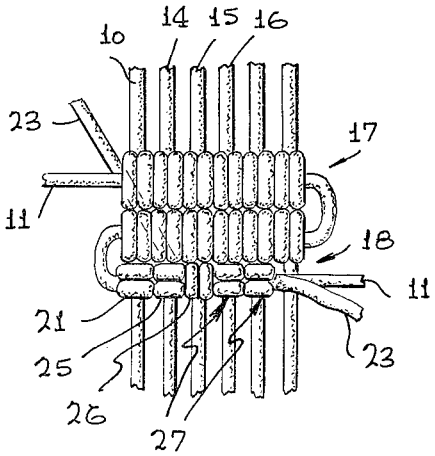
FIG. 10

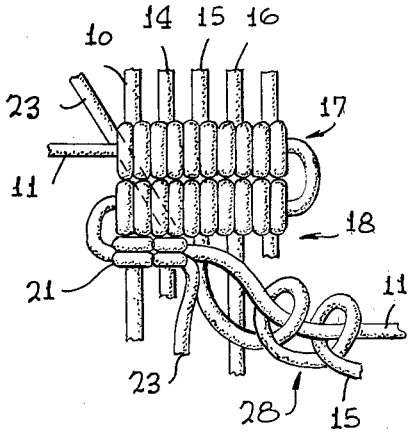
FIG. 11
FIG. 12
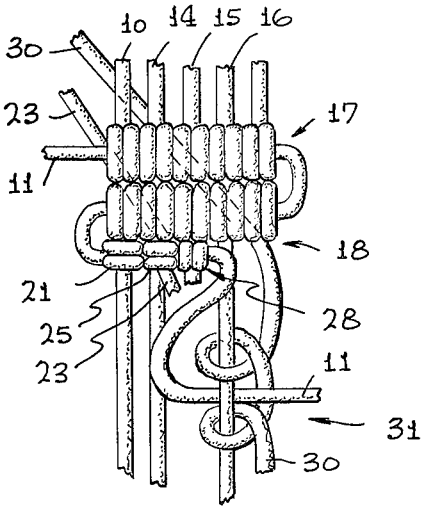
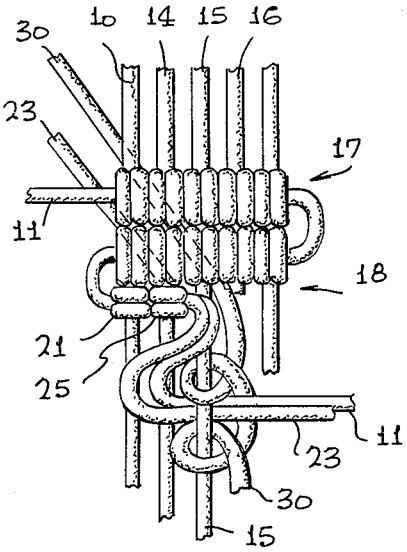
FIG. 13
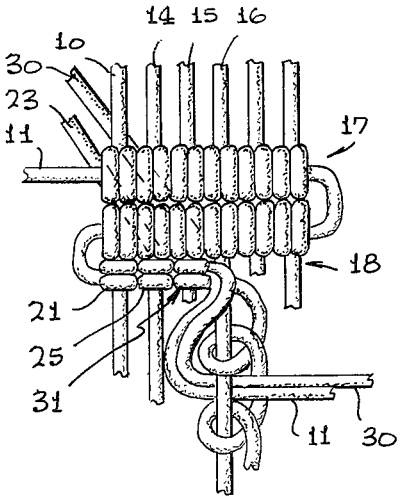
FIG. 14

FIG. 15
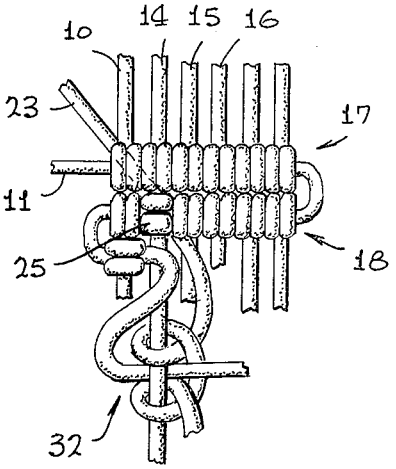
FIG. 16
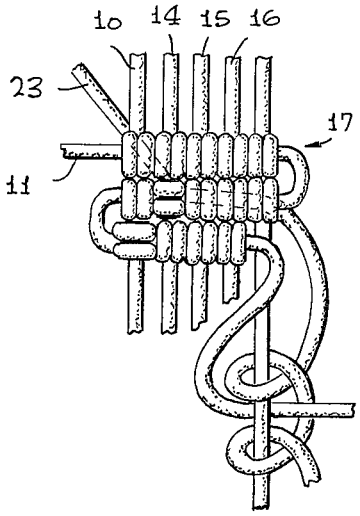
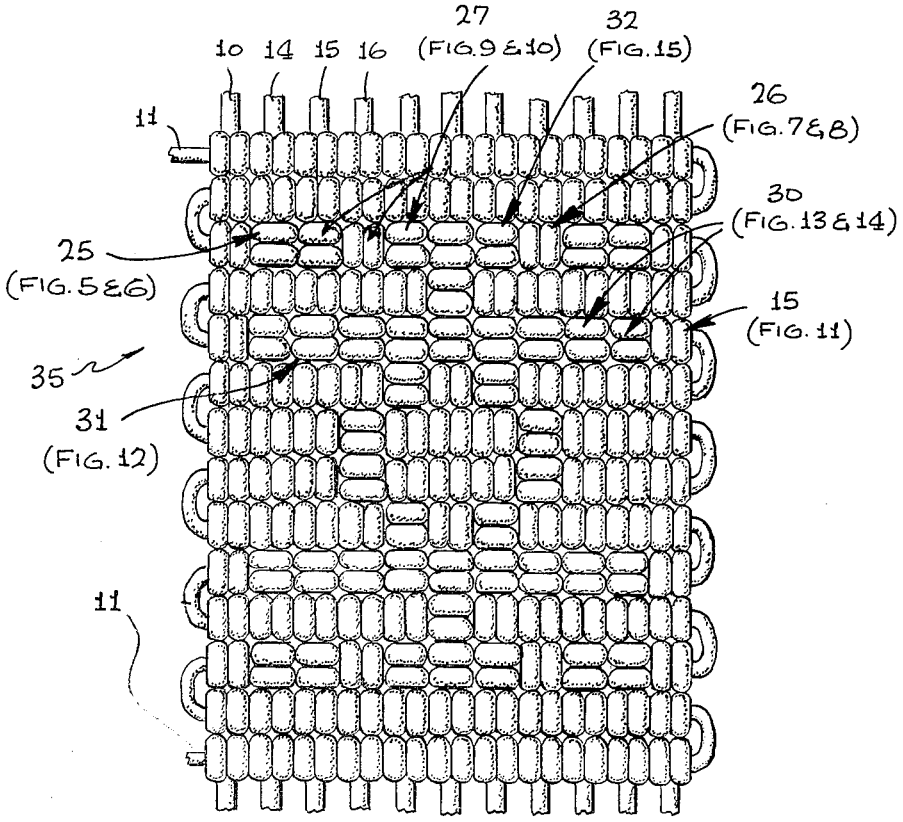
FIG. 17

WORK AND METHOD FOR INCLUSION OF THREE OR MORE CORDS OF DIFFERENT COLORS INTO A CAVENDOLI TYPE MACRAME PATTERN

BACKGROUND OF THE INVENTION

1. Field of the Invention

This invention relates to improvements in the field of macrame and more particularly to a novel method for and workpiece having three or more bobbin cords of different colors introduced into a desired pattern.

2. Brief Description of the Prior Art

In the past, it has been the conventional practice to produce decorative patterns by tying a plurality of double half hitch knots in cords so that the particular knot and/or color of cord designates a particular pattern. In the field of macrame pertaining to Cavendoli work in particular, a plurality of working cords are arranged in spaced relationship and parallel alignment so that a grid is provided. A main knot holding cord is threaded on the working cord and at a crossover location, it is normal to provide a double half hitch so that a multiplicity of such knots are provided adjacent one another in a given row across the working cords. A second or additional rows of knots are provided by reversing the main knot holding cord and tying double half hitches on each of the working cords until the main knot holding cord has crossed all of the working cord. Depending on a given pattern, either the working cord may be tied in half hitches about the main knot tying cord or the main knot tying cord may be tied in half hitches about the working cord. The resultant of the procedure determines which way the double half hitch knot will be showing.

Although the aforementioned procedure is conventional and is practiced with only two colors of cord, the end pattern would be greatly enhanced on the workpiece if a third or additional colors of cord could be added at selected times so that a highly distinctive pattern will result. No organized method has been or is available at the present time for introducing a third or more colors to form designs and pictures in a workpiece of this nature. To try to do this with only the present existing knowledge in this field of macrame presents many problems and tangled cords. When a particular color is desired in the pattern or design being worked, the need is to be able to add each color and continue or discontinue its use in a workpiece with the back and front of the workpiece remaining free from any tangle or maze of cords running across its surface. When the knotting of the workpiece is complete it will be turned to its back side and the beginning and ending points of the bobbin cords shall be threaded through a few knots and snipped off. The result of which is no cords will be showing on the back of the workpiece as previously described. This is important in this type of macrame project, expecially if the workpiece is to lie flat against the surface it is intended for.

Therefore, a longstanding need has existed to provide a new method or procedure for introducing a third or additional bobbin cords of different colors to a workpiece of this nature undergoing a knotting procedure so as to provide a desired pattern or design. Such a method should include a means for hiding or concealing the newly introduced bobbin cords from view in the overall pattern until such time as these bobbin cords are required in the construction of the pattern. Also, keeping the additional cords free from a mass of tangles running across the back of the workpiece.

SUMMARY OF THE INVENTION

Accordingly, the above problems and difficulties are obviated by the present invention which provides a novel means for introducing a third or additional colored bobbin cord to a workpiece undergoing construction during the performance of a knot tying procedure as in the field of macrame of the Cavendoli type. The workpiece of the present invention and the present method utilizes a plurality of working cords arranged in spaced apart parallel relationship so as to form a grid or framework. A main knotting cord is worked or threaded normal to the working cord by tying a double half hitch at the crossover point of each working cord. At a selected location in the workpiece, a third bobbin cord of different color is introduced by means of inserting the cord from the rear of the workpiece and forming a double half hitch on a working cord so that the double half hitch of the third bobbin cord of different color lies adjacent to the last knotted double half hitch of the main knotting cord. The free length of the third bobbin cord is directed through the workpiece where it will remain stored until ready for use in a subsequent knotting procedure. The free length of the main knotting cord is carried through the double half hitch of the third bobbin cord so that the free length is again available for forming a double half hitch on the next or subsequent working cords. By employing the main knotting cord of one color and the third or more bobbin cords of another color, decorative designs and patterns result on the workpiece.

Additional bobbin cords of different colors may be added at any time during the formation of the pattern on the workpiece by introducing the additional bobbin cord from the rear of the workpiece and tying a double half hitch about the next adjacent working cord so that both the free length of the main knotting cord and the free length of the third bobbin cord pass through the double half hitch formed by the additional bobbin cord.

Therefore, it is among the primary object of the present invention to provide a novel knot tying procedure forming a desired pattern and capable of introducing a plurality of bobbin cords to the pattern at any time during the conducting of knot tying procedures.

Another object of the present invention is to provide a novel method or technique for introducing a plurality of additional bobbin cords of different colors to a workpiece so that each of the bobbin cords may be introduced to the workpiece at a particular location and whereby the free length of the cord may be hidden from the pattern and stored directly inside the workpiece.

Still a further object of the present invention is to provide a series of techniques combined with conventional procedures for adding the use of any number of colors in a design pattern formed in the art of macrame of the Cavendoli type.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIGS. 1A–D inclusive are front elevational views of a normal knotting procedure used in the art of macrame of the Cavendoli type to form a decorative pattern;

FIG. 2 is a further extension of FIG. 1D showing an additional row of knots formed by a conventional half hitch wherein the main knot bearing or holding cord is tied onto a working cord;

FIG. 3 is a view similar to the view of FIG. 2 showing an additional half hitch tied onto a working cord;

FIG. 4 is a view similar to the views of FIGS. 2 and 3 showing a continuation of double half hitch knots formed on adjacent working cords by the main knot bearing or holding cord and wherein the knots in the rows are pulled tight to form the desired pattern;

FIGS. 5 and 6 are front elevational views similar to the view of FIG. 2; however a bobbin cord of a third color is introduced and pulled tight;

FIG. 7 is a view similar to the view of FIG. 6 showing how the third color of bobbin cord and the main knot holding cord are carried through the next horizontal double half hitch thereby concealing them from view or from the pattern when it is desired to again use the main knot holding cord;

FIG. 8 is a view similar to the view of FIG. 7 showing the knots pulled tight;

FIGS. 9 and 10 are views similar to the view of FIG. 8 showing the bobbin cord of a third color being knotted into the pattern again and pulled tight;

FIG. 11 is a front elevational view of a pattern showing an alternate procedure when a particular bobbin cord is no longer needed in a working row wherein the bobbin cord of a third or different color is dropped behind the pattern or cut off;

FIG. 12 is a front elevational view of a knotting pattern wherein a bobbin cord of a fourth color is added to the pattern as shown in FIG. 5;

FIG. 13 is a view similar to the view shown in FIG. 12 illustrating how both the main knot holding cord and the bobbin cord are carried through the knot made with the new bobbin cord;

FIG. 14 is a view similar to the view of FIG. 13 illustrating how the bobbin cord of a third color is again reintroduced to the pattern after knotting of the bobbin cord of the fourth color as shown in FIG. 13;

FIG. 15 is a view similar to that of FIG. 6, except the cord is directed to the back of the work to be used in the row below directly under the previous knot.

FIG. 16 is a view similar to the view of FIG. 7, except the same procedure is repeated on the cord adjacent to it, so as to hide from view both the bobbin cord and the main knot bearing cord, and put the bobbin cord in the position it is needed in the row below.

FIG. 17 is a front elevational view of the workpiece completed to show a desired pattern whereby the pattern is well defined and distinctly displayed.

DESCRIPTION OF PREFERRED EMBODIMENTS

Referring to FIG. 1A–D, a conventional method of performing a series of knot tying operations is illustrated which is commonly used in the field of macrame. In FIG. 1A, a working cord is identified by numeral 10 which is shown in the first stage of performing a double half hitch about a main knotting cord 11. In FIG. 1B the second half of the half hitch is illustrated while in FIG. 1C, a completed double half hitch knot is illustrated. It can be seen that one half of the double half hitch is identified by numeral 12 while the other half is identified by numeral 13. In FIG. 1D, a plurality of double half hitches are provided and are pulled tight so as to provide a row of completed knots. Additional working cords are illustrated and identified by numerals 14, 15 and 16.

In FIG. 2, a plurality or row of double half hitch knots is illustrated in the general direction of arrow 17 and a second row is illustrated in the general direction of arrow 18. The two rows of knots are formed in the manner illustrated with respect to FIGS. 1A–D inclusive about the main knot bearing or holding cord 11.

As an alternate method of providing a different design, FIG. 2 further illustrates that the main knot bearing or holding cord 11 can be tied into a double half hitch about the working cord 10 and after being pulled tight as shown in FIG. 3, a second double half hitch knot is placed on the working cord 14 adjacent to the double half hitch knot carried on working cord 10 immediately below row 18 of half hitches. After pulling the double half hitch tight, additional knots may be placed in subsequent working cords 15, 16 and the like so as to form a row in the direction of arrow 20 in FIG. 4. For clarification purposes, the double half hitch knot carried on the working cord 10 is identified by numeral 21 while the second knot formed as illustrated in FIG. 3 is identified by numeral 22 in FIG. 4.

As is the conventional practice, the working cords are normally of one color while the main knot bearing or holding cord 11 is a different color. Should the particular design or pattern call for a third color to be included, the method must be expanded to include a procedure for introducing a third or more different color cords, known as bobbin cords. The bobbin cord is normally of a different color than the other cords previously mentioned. The second bobbin cord of a different color is identified in FIG. 5 by the numeral 23 and, for purposes of explantation, is illustrated as being introduced from the backside of the overall workpiece so as to project forwardly immediately beneath last row of knots identified by numeral 18 and immediately ahead of knot 21. The bobbin cord 23 is then formed in a half hitch over the working cord 14 so that each half of the half hitch is on opposite sides of the free length of main knot bearing cord 11, with cord number 11 lying beneath cord 14. The free length of cord 11 is illustrated as being threaded or passed behind the working cord 14 and then through the center of the double half hitch knot. After the knot has been pulled tight, the design will be as shown in FIG. 6 and the double half hitch knot tied by the bobbin cord of a third color is illustrated by numeral 25. The main knot bearing or holding cord 11 and the third colored bobbin cord 23 are positioned on the front side of the overall pattern ready for forming another knot as desired by the pattern using the principles just previously discussed.

Referring now in deatil to FIG. 7, a variation to the design shown in FIG. 6 is presented wherein the next working cord 15 is employed for forming a double half hitch knot about both of the main bearing knot cord and the third colored bobbin cord 23. When completed and pulled tight, this latter knot is identified by numeral 26 in FIG. 8. If pattern calls for such, any variation previously described may now be tied into the pattern using either the next working cord, the main knot bearing or holding cord or the third or more colored bobbin cords.

FIG. 9 illustrates the continuation of the pattern by employing the second bobbin cord of a fourth color for tying a knot about the next working cord so that the main knot bearing or holding cord 11 passes through each part of the half hitch so formed. Upon completion and pulling tight, the knot will look the same as knot 25 and is illustrated by the numeral 27 in FIG. 10.

Therefore, in FIGS. 7 and 8 it can be seen that both the main knot bearing cord and the bobbin cord are carried through the horizontal double half hitch since the bobbin cord is needed directly on the other side of the horizontal double half hitch adjacent to the half hitch 21. In FIGS. 9 and 10, the bobbin color is carried through the vertical double half hitch to keep work from developing a hole. By passing the main knot bearing or holding cord in the third bobbin color cord through the working cord as shown in FIGS. 7 and 8, the double half hitch so provided conceals, covers or hides the main knotting cord and the bobbin cord from view from the front of the pattern.

Referring now in detail to FIG. 11, an alternate procedure or method is illustrated. This procedure is used when the first bobbin cord is no longer needed in the working pattern or working row; however, the second bobbin cord may be needed again in the next or further rows and therefore must be kept available behind the workpiece. Therefore, the object is to direct the third color bobbin cord behind the workpiece pattern so it will not show in the pattern. Instead of bringing the cord through as previously described, the bobbin cord is dropped behind and covered with a double half hitch formed by the working cord 15 wherein the double half hitch is indicated by numeral 28 in FIGS. 11 and 12.

In FIG. 12, a second bobbin cord of a fourth color is added and is indicated by the numeral 30. The bobbin cord 30 is tied in a half hitch in the direction of arrow 31 about the next working cord in the series as identified by numeral 16. In so performing, the main knot bearing or holding cord 11 is passed through the center of the double half hitch and lies beneath cord 16.

In FIG. 13, a similar pattern procedure is shown to that illustrated in FIG. 12 with the exception that no double half hitch of working cord 15 is employed so that the first and second bobbin color cords are adjacent to each other. In otherwords, it is desired in the pattern to have the knot 25 and 31 adjacent to each other and not separated by the knot 28 as shown in FIG. 12. To achieve this end result, both the main knot bearing or holding cord 11 and the first bobbin cord 23 are passed directly through the center of the knot 31 and under cord 15 in its formation. The second bobbin cord 30 of a fourth color is tied into the double half hitch with cords 11 and 23 passing through and knot 31 formed thereby is shown in a tight position in FIG. 14 adjacent to the knot 25 formed by the first bobbin cord of the third color.

In FIG. 15 it can be seen that cord 25 was dropped behind the work to be used in the row below at a point in the row directly beneath its previous use. It is identified by the numeral 14.

In FIG. 16 it can be seen that the first bobbin cord and the main knot bearing cord are carried through the horizontal double half hitch thereby, concealing from view the cords represented by numerals 15 and 16. This is done because the bobbin cord is desired to be knotted in the row below on the cord represented by the numeral 17.

Referring now in detail to the overall pattern displayed on the workpiece in FIG. 17, the workpiece is indicated in the general direction of arrow 35 where it can be seen that the main knot holding or working cord 11 travels through the entire work and represents one color while the working cords 10, 14, and 15 and 16 represent another color. As illustrations of the knots described, FIGS. 5 and 6 in the workpiece have been completed and are represented as numeral 25. FIGS. 7 and 8 in the workpiece have been completed and are represented as numeral 26. FIGS. 9 and 10 in the workpiece have been completed and are represented as numeral 27. FIG. 11 in the workpiece has been completed and is represented as numeral 15. FIG. 12 in the workpiece has been completed and is represented by the numeral 30. FIGS. 13 and 14 in the workpiece have been completed and are represented by the numeral 31. FIG. 15 in the workpiece has been completed and is represented by numeral 32. FIG. 16 was not needed in this particular pattern and is not represented as it is a repetition of FIG. 7, done consecutively twice in a row. It should be noted that this FIGURE can be done any number of times as a particular pattern may call for.

Also, at times, it is possible to work cords across the back of the workpiece. For the most part, this practice is not recommended if a perfectly flat surface is desired or if it is desired that all the cords be contained inside the workpiece.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A knotted workpiece defining a desired pattern comprising:

a plurality of working cords arranged in spaced apart rows:

a main knot holding cord woven through and tied to respective ones of said working cords in a multiplicity of double half hitch knots;

a first bobbin cord of a different color than said working cords and said main holding cord introduced into the workpiece adjacent a pair of double half hitch knots on the next one of said working cords;

said first bobbin cord being passed through each half hitch of said multiplicity of double half hitch knots; and a free terminating end of said first bobbin cord lying hidden behind subsequent work in the pattern of said workpiece for re-use for additional double half hitch knots.

2. The invention as defined in claim 1 including:

additional bobbin cords of various colors carried on additional working cords in double half hitches;

said main holding cord and said first bobbin cord of different color being passed through each of said latter mentioned double half hitches.

3. The invention as defined in claim 2 wherein:

all of said aforementioned knots and hitches are characterized as being drawn tight about their respective working cords whereby the desired pattern is sharply defined and displayed.

4. The invention as defined in claim 1 including:

additional bobbin cords of different colors extending from the rear of the workpiece and attachment to the next adjacent one of said working cords by tying a double half hitch so that both the free length of said main holding cord and the free length of a third bobbin cord pass through said double half hitch provided by said additional bobbin cord.

5. The method of introducing a third or additional colored bobbin cord to a workpiece undergoing construction during the performance of a knot tying procedure in the field of macrame of the Cavendoli Type, the steps which comprise:

arranging working cords in spaced apart parallel relationships so as to form a grid or framework;

working a main knot holding cord normal to said working cords by tying a double half hitch at the crossover point of each said parallel arranged working cords;

introducing a third bobbin cord of different color by inserting the cord from the rear of the workpiece;

forming a double half hitch on a selected working cord so that the double half hitch of the third bobbin cord of different color lies adjacent to the last knotted double half hitch of the main holding cord; and directing the free length of the third bobbin cord of different color through the workpiece where it will remain stored until ready for subsequent use.

6. The method as defined in claim 5 including the step of:

carrying the free length of the main holding cord through the double half hitch of the third bobbin cord of different color so that the free length is again available for forming a double half hitch on the next or subsequent working cords.

7. The method as defined in claim 6 including the step of:

adding additional bobbin cords of different colors during the formation of the pattern on the workpiece by introducing the additional bobbin cords from the rear of the workpiece and tying a double half hitch about the next adjacent working cord so that both the free length of the main holding cord and the free length of the third bobbin cord pass through the double half hitch formed by the additional bobbin cord.

* * * * *